United States Patent [19]

van Gulik

[11] Patent Number: 4,489,761

[45] Date of Patent: Dec. 25, 1984

[54] HAND WEAVING LOOM

[76] Inventor: Johannes W. van Gulik, Illikhoven 12, 6116 Al Roosteren, Netherlands

[21] Appl. No.: 495,484

[22] Filed: May 17, 1983

[30] Foreign Application Priority Data

May 19, 1982 [BE] Belgium ..... 893.240

[51] Int. Cl.[3] ..... D03D 29/00

[52] U.S. Cl. ..... 139/29; 139/33

[58] Field of Search ..... 139/29–33, 139/34; 28/151, 152

[56] References Cited

U.S. PATENT DOCUMENTS

| | | | |
|---|---|---|---|
| 1,176,822 | 3/1916 | Elsaser | 139/33 |
| 2,193,558 | 3/1940 | Gallinger | 139/33 |
| 2,619,989 | 12/1952 | Sargent | 139/33 |
| 2,803,267 | 8/1957 | Macomber | 139/30 |

FOREIGN PATENT DOCUMENTS

| | | | |
|---|---|---|---|
| 49-8422 | 2/1974 | Japan | 139/33 |
| 52109 | 1/1933 | Norway | 139/29 |

*Primary Examiner*—James Kee Chi

*Attorney, Agent, or Firm*—Oblon, Fisher, Spivak, McClelland & Maier

[57] ABSTRACT

A hand weaving loom comprising a frame provided with a loom beam and a breast beam between which the warp threads are stretched in operation, the warp threads being guided between the loom beam and the breast beam along guide members which are movable in a direction transverse of the warp threads away from and towards one another with the aid of a driving mechanism to be actuated by hand or foot, whereby said two beams are relatively displaceable in a direction towards and away from one another with the aid of the driving mechanism in a manner such that, when the guide members are moved away from one another, the beams move towards one another, whereas the beams are spaced apart by the maximum distance when the warp threads are located at least substantially in the same plane.

6 Claims, 2 Drawing Figures

HAND WEAVING LOOM

BACKGROUND OF THE INVENTION

1. Field of the Invention

The invention relates to a hand weaving loom comprising a frame provided with a loom beam and a breast beam, between which the warp threads are stretched in operation, and wrap threads being guided between the loom beam and the breast beam along guide members which are movable in a direction transverse of the wrap threads away from and towards one another through a driving mechanism to be actuated by hand or foot.

2. Description of the Prior Art

Such hand weaving looms are known per se. During the weaving operation the guide members have to be moved away from one another for passing each weft thread, after which the guide members are moved towards one another, the weft thread is struck home and the guide members are again moved away from one another in the opposite direction for inserting the next weft thread.

Since normally the warp threads are stretched firmly between the breast beam and the loom beam, the movement of the guide members away from one another to form the so-called parting requires much effort, whilst the tension of the warp threads highly increases so that the actuation of the hand weaving loom requires a high amount of effort and, in addition, undesirably high tensions are produced in the warp threads, which may give rise to breakage. This phenomenon occurs in particular when the distance between the loom beam and the breast beam is relatively small, in which also the size of the so-called parting is small.

SUMMARY OF THE INVENTION

According to the invention the two beams are relatively displaceable in a direction towards and away from one another with the aid of the driving mechanism in a manner such that, when the guide members are moved away from one another, the beams move towards one another, whereas the beams are spaced apart by the maximum distance when the warp threads are located at least substantially in the same plane.

By using the construction embodying the invention an appreciable reduction of the effort required to form the so-called parting can be observed, whilst in addition the exertion of undesirable forces on the warp threads is avoided. Moreover, the magnitude of the so-called parting can be raised to the maximum, desired value. In addition, it appears that a markedly more uniform texture of the final woven products is obtained in this way.

The invention will be described more fully hereinafter with reference to a few embodiments schematically shown in the accompanying drawings of the construction according to the invention.

DETAILED DESCRIPTION OF THE PREFERRED EMBODIMENTS

Figure 1:
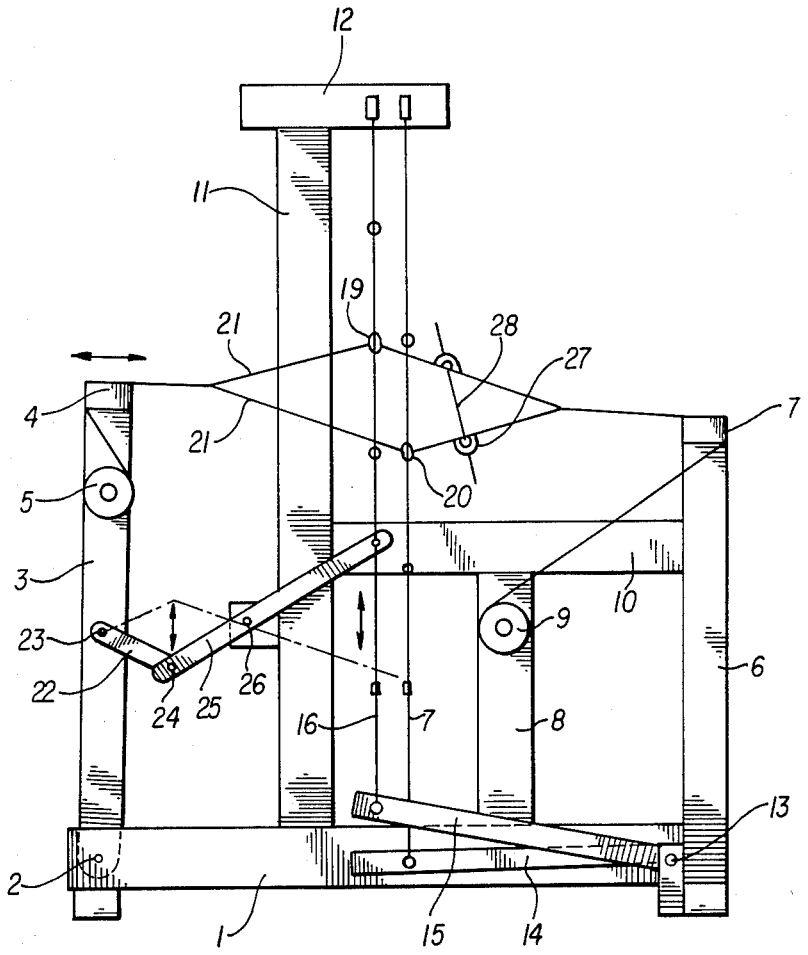
FIG. 1 schematically shows a first embodiment of a weaving loom in accordance with the invention.

The embodiment shown in FIG. 1 of a weaving loom in accordance with the invention comprises a frame having a base framework 1 to which upwardly extending pivoted supporting members 3 are pivoted with the aid of horizontal pivot pins 2.

The pivoted supporting members beams 3 support at their top ends a loom beam 4, arranged between the members 3 as well as a warp beam 5 located below said loom beam.

On the opposite side of the base framework 1 are fastened upwardly extending beams 6 supporting at their top ends a breast beam 7 extending parallel to the loom beam.

Between frame beams 8 fastened to the base framework and extending parallel to the beams 6 there is furthermore arranged a cloth beam 9.

The top ends of the frame beams 8 are connected by means of beams 10 extending parallel to the base framework 1 with the beams 6 as well as with beams 11 extending parallel to the beams 6 and fastened to the base framework 1. The beams 11 are supporting at their top ends a framework 12 extending between the beams 11.

With the frame are furthermore pivotally coupled two treadles 14 and 15 with the aid of horizontal pivot shafts 13.

To the ends of the treadles 14 and 15 remote from the pivotal shafts 13 are fastened the relatively parallel parts 16 and 17 of a flexible member, for example, a cable which is guided in the framework 12 at the transitional area between the two parts. It will be obvious that when the treadle 15 is pressed down by a foot, the treadle 14 will move upwards and conversely. If desired the guide members can be driven independently from each other.

With the parts 16 and 17 are coupled in known manner guide members 19 and 20 respectively, through which warp threads 21 are passed. The number of parts 16 and 17 and/or the number of guide members 19 and 20 can be varied and will depend on the desired possibilities for the device. These warp threads are stretched between the warp beam 5 and the cloth beam 9 and guided along the loom beam and the breast beam in a conventional manner.

From FIG. 1 it is furthermore apparent that one end of a coupling rod 22 is coupled with one of the pivoted supporting members 3 with the aid of a pivot pin 23. The other end of the coupling rod 22 is pivoted to one end of a lever 25 with the aid of a pin 24 extending parallel to the pin 23. The other end of the lever 25 is connected with the part 16, whilst between its ends the lever is pivotally coupled with the frame with the aid of a shaft 26 extending parallel to the pin 24.

The device furthermore comprises a conventional weaving drawer 27 and a reed 28 shown only schematically in the Figure.

In the position illustrated in FIG. 1 the treadle 14 is pushed down and the treadle 15 is in its topmost position, in which the warp threads are drawn away from one another to form the so-called parting in the manner shown in the Figure. In this position the weft thread is inserted, after which by depressing the treadle 15 the guide members 19 and 20 are moved towards one another into a position in which the warp threads are located at least substantially in one plane and the inserted weft thread can be struck home. When the guide members 19 and 20 are moved towards one another the end of the lever 25 coupled with the part 16 moves downwards so that the loom beam is turned to the left as viewed in FIG. 1. As a result the warp threads are maintained in the taut state when the so-called parting is closed. The design is such that when the warp threads 21 are located in one plane, the centre lines of the pins 23 and 24 and the shaft 26 are also co-planar. At a further downward movement of the treadle 15 the warp threads are again parted from one another, whilst the coupling rod 22 and the lever 25 turn into the position shown by broken lines in the Figure so that parting of the warp threads occurs simultaneously with a right-hand turn of the loom beam, as viewed in FIG. 1, as a result of which parting of the warp threads does substantially not require any effort, whilst no high tension is produced in the warp threads.

A special object according to the invention is to keep constant the tension in the warp threads as much as possible during operation. This means that the displacement of the movable beams of the guide members are related such to each other that the length of the warp threads in straightly tensioned condition between both beams 4 and 7, at the maximum distance between the beams is substantially equal to the length of the warp threads being between the beams moving to each other and guide members moving from each other.

Figure 2:
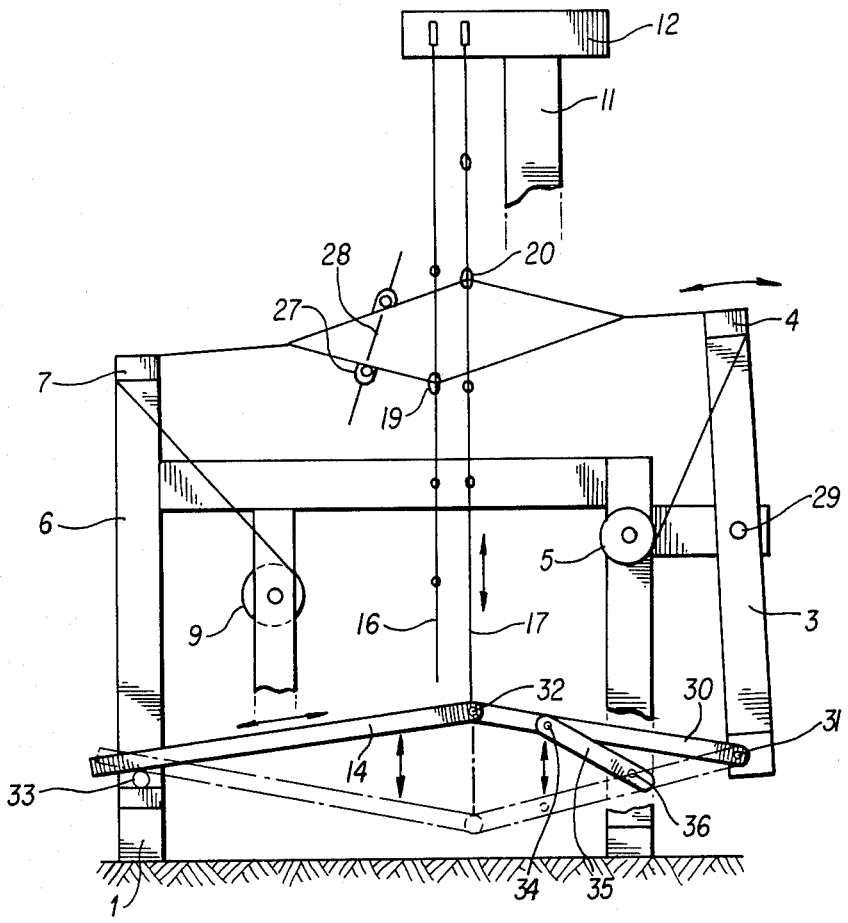
FIG. 2 schematically shows a second embodiment of a weaving loom in accordance with the invention.

FIG. 2 schematically shows a second embodiment of the construction in accordance with the invention. Those parts which correspond with the parts shown in FIG. 1 are designated by the same reference numerals as in FIG. 1.

From FIG. 2 it is apparent that the pivoted supporting members 3 are pivoted to the frame between their ends rather than near their bottom ends with the aid of horizontal pivotal shafts 29. With the lower end of the pivoted supporting member 3 is coupled one end of a first coupling rod 30 with the aid of a shaft 31 extending parallel to the shaft 29. The other end is pivoted to one end of the treadle 14 with the aid of a horizontal pivot pin 32. The end of the treadle 14 remote from the pivot pin 32 is not pivoted, as in the first embodiment, with the aid of a pivotal shaft to the frame, but said end is bearing on a roller 33 supported by the frame so that the treadle 14 cannot only turn but also shift in its direction of length.

Between its ends the arm 30 is furthermore provided with a shaft 34 extending parallel to the shafts 31 and 32, by means of which a second coupling rod 35 is coupled at one end in a pivotable manner with the first coupling rod 30. The other end of the second coupling rod 35 is pivoted to the frame by means of a pivot pin 36.

From FIG. 2 it will be apparent that in this embodiment the treadle 14 and the first coupling rod 30 connected herewith can reciprocate between the position indicated by solid lines and the position indicated by broken lines, as a result of which the warp threads are moved away from one another to form the parting and subsequently towards one another, whilst at the same time the loom beam will turn to and fro about the shaft 29. Consequently the operation of this device is, in principle, the same as that of the device described with reference to FIG. 1. For the sake of clarity the treadle 15 is not shown in the Figure.

As a matter of course, complementary steps and/or variations of the construction described above are possible within the spirit and scope of the invention. For example, instead of being pivotable the loom beam may be arranged in the frame so as to be reciprocatory.

I claim:

1. A hand weaving loom for weaving warp and weft threads comprising:

a frame, a loom beam and a breast beam mounted to said frame, said loom beam and said breast beam comprising means for tensioning all warp threads therebetween, at least one of said loom and breast beams being displaceable toward the other of said loom and breast beams, a plurality of guide members for individually slidably receiving said warp threads, driving means for simultaneously displacing said one beam with respect to said other beam and a first group of said guide members with respect to a second group of said guide members in a direction transverse to said warp threads, wherein said first group of said guide members and said second group of said guide members move away from each other when said one beam moves toward said other beam, and wherein all said warp threads are in substantially the same plane when said loom and breast beams are at their maximum relative spacing.

2. A hand weaving loom as claimed in claim 1, wherein said one of said loom and breast beams is mounted to a pivoted supporting member, said pivoted supporting member being mounted by a pivotal axis transverse to said warp threads.

3. A hand weaving loom as claimed in claim 2, wherein said driving means further comprises a treadle pivotally mounted to said frame and a flexible member extending between said treadle and a guide member, said loom further comprising a lever pivotally mounted to said frame at a point intermediate its ends and a coupling rod, a first end of said coupling rod being pivotally connected to said pivotal supporting member, a second end of said coupling rod being pivotally connected to a first end of said lever, and a second end of said lever being connected to said flexible member.

4. A hand weaving loom as claimed in claim 3 characterized in that, in the position wherein said breast and loom beams are situated at the greatest distance from each other, the pivot axes of said coupling rod and lever are all situated in a single plane.

5. A hand weaving loom as claimed in claim 2, wherein said pivoted supporting member is pivoted at a point intermediate first and second ends thereof and said one of said breast and loom beams is mounted to said first end of said pivoted supporting member, said loom further comprising a treadle and first and second coupling rods, a first end of said first coupling rod being pivotably connected to said second end of said pivoted supporting member, a second end of said first coupling rod being pivotally connected to said treadle, and said second coupling rod being pivotally connected between said frame and said first coupling rod.

6. A hand weaving loom as claimed in claim 5, wherein an end of said treadle remote from said first coupling rod is supported such that said treadle is pivotable and slidable in its direction of length.

* * * * *